US008960991B2

(12) United States Patent
Vogt et al.

(10) Patent No.: US 8,960,991 B2
(45) Date of Patent: Feb. 24, 2015

(54) PMMA BONE PASTE MIXING APPARATUS AND METHOD

(75) Inventors: Sebastian Vogt, Erfurt (DE); Hubert Büchner, Nürnberg (DE)

(73) Assignee: Heraeus Medical GmbH, Wehrheim (DE)

( * ) Notice: Subject to any disclaimer, the term of this patent is extended or adjusted under 35 U.S.C. 154(b) by 1007 days.

(21) Appl. No.: 13/012,349

(22) Filed: Jan. 24, 2011

(65) Prior Publication Data

US 2011/0184083 A1 Jul. 28, 2011

(30) Foreign Application Priority Data

Jan. 26, 2010 (DE) ..... 10 2010 005 864

(51) Int. Cl.

| | |
|---|---|
| ***B01F 3/12*** | (2006.01) |
| ***B01F 7/16*** | (2006.01) |
| ***B01F 7/00*** | (2006.01) |
| ***B01F 15/02*** | (2006.01) |

(52) U.S. Cl.

CPC ..... *B01F 7/00291* (2013.01); *B01F 7/00391* (2013.01); *B01F 15/0289* (2013.01); *B01F 2215/0029* (2013.01)

USPC ..... 366/75; 366/81; 366/82; 366/84; 366/88; 366/139; 366/293; 366/295; 366/297; 366/303; 366/307; 366/319; 366/323; 422/135; 422/228; 422/229; 523/116

(58) Field of Classification Search

CPC .. B01F 3/1221; B01F 3/00416; B01F 7/0045; B01F 7/00625; B01F 7/1665; B01F 7/167; B01F 7/1675

USPC ..... 366/75, 81, 82, 84, 88, 139, 293, 295, 366/297, 303, 307, 319, 323; 422/135, 228, 422/229; 523/116

See application file for complete search history.

(56) References Cited

U.S. PATENT DOCUMENTS 1,268,813 A * 6/1918 Benjamins ..... 366/76.9
3,300,811 A * 1/1967 Berger ..... 366/85

(Continued)

FOREIGN PATENT DOCUMENTS

EP 0674888 A1 10/1995
EP 2052747 A2 4/2009

(Continued)

OTHER PUBLICATIONS

Office Action issued Dec. 9, 2010 in German Appln. Ser. No. 10 2010 005 864.5.

J. Charnley, "Anchorage of the Femoral Head Prothesis to the Shaft of the Femur," The Journal of Bone and Joint Surgery, vol. 42B, No. 1, pp. 28-30 (1960).

Office Action issued Aug. 24, 2012 in CA Application No. 2,726,954.

Notice of Acceptance issued Nov. 26, 2012 in AU Application No. 2011200103.

*Primary Examiner* — Robert B Davis

(74) *Attorney, Agent, or Firm* — Panitch Schwarze Belisario & Nadel LLP

(57) ABSTRACT

A device is provided with which it is possible to produce poly(methyl methacrylate) bone-cement paste, which is degassed to the greatest extent possible, while avoiding large-volume mixing containers and large cement volumes contained therein. The device includes a tubular hollow body (10) having a first opening (30) on the input side and a second opening (20) on the output side, at least one rotatably-mounted shaft (40) arranged in the axial direction in the tubular hollow body (10), thread turns (50) arranged axially along the outer side of the shaft (40), wherein the shaft (40) has at least one section with thread turns (50) whose pitch decreases in the direction of the second opening (20), at least one stirring blade (60) arranged on the shaft (40), and rigid mixing elements (70) arranged on the inner side of the tubular hollow body (10).

15 Claims, 2 Drawing Sheets

(56) References Cited

U.S. PATENT DOCUMENTS

| | | | | | |
|---|---|---|---|---|---|
| 4,015,945 | A | | 4/1977 | Frankel et al. | |
| 4,117,073 | A | * | 9/1978 | Koch et al. | 264/349 |
| 5,071,040 | A | * | 12/1991 | Laptewicz, Jr. | 366/189 |
| 5,108,711 | A | * | 4/1992 | Chszaniecki | 422/135 |
| 5,320,796 | A | * | 6/1994 | Harashima et al. | 366/82 |
| 5,876,116 | A | | 3/1999 | Barker et al. | |
| 6,033,105 | A | * | 3/2000 | Barker et al. | 366/182.3 |
| 6,699,214 | B2 | * | 3/2004 | Gellman | 604/82 |
| 6,837,612 | B2 | * | 1/2005 | Bublewitz et al. | 366/172.1 |
| 7,090,391 | B2 | * | 8/2006 | Taniguchi | 366/118 |

FOREIGN PATENT DOCUMENTS

| | | | |
|---|---|---|---|
| EP | 2052748 | A2 | 4/2009 |
| JP | 2003181270 | A | 7/2003 |

* cited by examiner

PMMA BONE PASTE MIXING APPARATUS AND METHOD

BACKGROUND OF THE INVENTION

The subject matter of the invention is a mixing device and a method for the production of paste-like poly(methyl methacrylate) bone-cement pastes.

Conventional PMMA bone cements have been known for decades and trace back to the basic work done by Sir Charnley (Charnley, J.: "Anchorage of the femoral head prosthesis of the shaft of the femur," *J. Bone Joint Surg.* 42: 28-30 (1960)). In principle, the basic formulation of the PMMA bone cements has remained the same since then. PMMA bone cements comprise a liquid monomer component and a powder component. The monomer component includes, in general, (i) the monomer methyl methacrylate and (ii) an activator (for example, N,N-dimethyl-p-toluidine) dissolved in this monomer. The powder component comprises (i) one or more polymers produced by polymerization, preferably suspension polymerization, on the basis of methyl methacrylate and comonomers, such as styrene, methyl acrylate, or similar monomers, (ii) a radiopaque material, and (iii) an initiator (for example, dibenzoyl peroxide). Upon mixing the powder component with the monomer component, a plastically deformable paste is produced due to swelling of the polymers of the powder component in the methyl methacrylate of the monomer component. Simultaneously, the activator N,N-dimethyl-p-toluidine reacts with the dibenzoyl peroxide, which breaks down with formation of radicals. The formed radicals initiate the radical polymerization of the methyl methacrylate. With advancing polymerization of the methyl methacrylate, the viscosity of the cement paste increases until the paste solidifies and is thus cured.

The significant disadvantage of the conventional PMMA bone cement for the medical user consists in that the user must mix the liquid monomer component with the powder component in a mixing system or crucibles directly before the application of the cement. Here, mixing errors can easily occur, which could negatively affect the cement quality. Furthermore, the mixing of the components must be performed in an uninterrupted process. Here, it is important that the entire cement powder is mixed with the monomer component without the formation of clumps and that, during the mixing process, the entry of air bubbles is avoided. With the use of vacuum mixing systems, in contrast to hand mixing, the formation of air bubbles in the cement paste is largely prevented. Examples of mixing systems are disclosed in the publications U.S. Pat. No. 4,015,945, European patent application publication EP 0 674 888 A1, and Japanese patent application publication (Kokai) JP 2003/181270 A. Vacuum mixing systems, however, make an additional vacuum pump necessary and are therefore relatively expensive. Furthermore, after the mixing of the monomer component with the powder component, depending on the type of cement, a certain amount of time must elapse until the cement paste is non-adhesive and can be applied. Due to the many possible errors in the mixing of conventional PMMA bone cements, appropriately trained personnel are also needed. The appropriate training is associated with considerable costs. Furthermore, the mixing of the liquid monomer component with the powder component leads to an exposure of the user to monomer vapors and to the release of powdery cement particles.

Paste-like bone cements represent an interesting alternative to conventional cements formulated from a powder component and a liquid component. Such paste-like bone cements are described, for example, in European patent application publications EP 2 052 747 A2 and EP 2 052 748 A2. Two-component paste cements are formulated from two storage-stable, paste-like components, which after mixing yield a cement paste that cures within a few minutes. These pastes are made available to the medical user in cartridges or in tubular bags. These bone-cement pastes contain at least (i) a monomer, (ii) a polymer soluble in this monomer, and (iii) a polymer insoluble in this monomer and/or other fillers. In addition, components of redox initiator systems are contained in the cement pastes. Furthermore, it is also possible to produce single-component-paste bone cements which, in contrast to two-component systems, are brought to polymerization by action of energy, for example by changing magnetic fields.

For the production of these cement pastes, a powder-like cement component A and a liquid monomer component B are mixed. The powder-like component A comprises a polymer soluble in the monomers of the monomer component B, a polymer insoluble in the monomers of the monomer component B and/or fillers. Upon mixing of the powder-like cement component A with the liquid monomer component B, the polymer soluble in the monomer or monomer mixture swells, before it then dissolves in the monomer/monomer mixture. The viscosity of the mixture here increases greatly, so that the mixture forms a paste. The viscosity of the paste is so high that the insoluble polymer and/or the fillers do not settle out. With the use of quickly swelling, soluble polymers, this process takes place within 5-30 minutes. During this swelling phase, it is necessary to stir or to knead the mixture, so that no phase separation can take place through sedimentation. Thereafter, the soluble polymer swells only to a slight extent.

The production of pastes is a typical process in the food and adhesive industries, which is performed with the help of large-volume mixing vessels. Here, at least one mixing of the paste components is performed with conventional blade or rod stirrers. The formed pastes are pressed out from the mixing vessels through fitted movable covers with the help of presses into suitable packaging means, such as cartridges, tubular bags, and tubes. The degassing of the formed paste-like materials, however, is problematic due to their viscosity that is, in part, very high.

The monomer mainly contained in bone-cement pastes, methyl methacrylate, involves a very reactive and volatile liquid. Besides methyl methacrylate, dissolved polymers, as for example poly(methyl methacrylate), are also contained in the bone-cement pastes. Upon mixing of the poly(methyl methacrylate) with the methyl methacrylate, a gel is formed. Therefore, cement pastes are in a gel-like state. The monomer mixtures contained in the cement pastes are then already extremely reactive when the cement paste is in a gel-like state. Consequently, these systems have a certain tendency for spontaneous polymerization.

In radical polymerization methyl methacrylate releases an enthalpy of reaction of −59 kJ/mol. Typical preparation containers have a holding capacity of ca. 200 liters. At the start of paste cement of ca. 200 kg, which contains ca. 40 weight percent monomer, ca. 80 kg (corresponding to 800 mol) of methyl methacrylate is included. With an undesired spontaneous polymerization of these starting materials, an energy of approximately −47,200 kJ would be released within a few minutes, which could lead to a conflagration or to an explosion. Furthermore, after spontaneous polymerization of the cement paste, the very expensive preparation containers are no longer usable, because the cured bone-cement pastes are mechanically very resistant. Therefore, the use of conventional preparation containers for the production of bone-cement pastes is very problematic. Furthermore, the degassing of the formed cement paste has also proven to be problematic.

Air residues enclosed in the cement pastes can, on one hand, negatively affect the storage capacity of the pastes due to the included oxygen and, on the other hand, air inclusions can degrade the mechanical stability of the cured cement.

BRIEF SUMMARY OF THE INVENTION

The invention is therefore based on the object of providing a device with which it is possible to produce poly(methyl methacrylate) bone-cement paste, which has been degassed to the greatest extent possible while avoiding large-volume mixing containers and large cement volumes contained in these containers. Furthermore, a method for the production of poly(methyl methacrylate) bone-cement pastes, which are degassed to the greatest extent possible, should also be made available, wherein this method proceeds without the use of large-volume mixing containers.

The object according to the invention is achieved by a device for the production of poly(methyl methacrylate) bone-cement pastes from a powder-like cement component A and a liquid monomer component B, comprising a tubular hollow body having a first opening on the input side and a second opening on the output side, at least one rotatably-mounted shaft arranged in the axial direction in the tubular hollow body, thread turns arranged axially along the outer side of the shaft, wherein the shaft has at least one section having thread turns whose pitch decreases in the direction of the second opening, at least one stirring blade arranged on the shaft, and rigid mixing elements arranged on the inner side of the tubular hollow body.

Furthermore, the object according to the invention is achieved by a method for the production of poly(methyl methacrylate) bone-cement pastes from a powder-like cement component A and a liquid monomer component B using the previously described device, in which the powder-like cement component A is introduced continuously through the first supply opening and the liquid monomer component B is introduced continuously through the second supply opening into the tubular hollow body, wherein a cement mixture C is formed by swelling, and causes axial rotational movements of the shaft, whereby a mass flow of the cement mixture C is generated from the first opening in the direction of the second opening, and the cement mixture is pressed out from the second opening.

The device according to the invention allows the continuous production of largely degassed cement pastes.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. Shown in the drawings are.

DETAILED DESCRIPTION OF THE INVENTION

The device according to the invention allows the production of poly(methyl methacrylate) bone-cement pastes. Poly (methyl methacrylate) bone-cement pastes involve paste-like compositions that contain the polymer poly(methyl methacrylate) and are preferably used for the production of bone cement. The poly(methyl methacrylate) bone-cement pastes can, on one hand, be brought to polymerization with the production of bone cement, in contrast to suitable initiator systems, for example, directly by the action of energy and thus without mixing with additional components. On the other hand, the bone cement can also be produced by the mixing and curing of more than one bone-cement paste. These bone-cement pastes themselves are generated according to the invention with the use of the device described herein. Here, at least one powder-like cement component A and one liquid monomer component B are mixed with each other.

The monomer component B comprises at least one monomer. The monomer can include, for example, a mono-functional methacrylic acid ester. An especially preferred methacrylic acid ester is methyl methacrylate. The powder-like cement component A preferably contains a polymer soluble in the monomers of the monomer component B, as well as a polymer insoluble in the monomers of the monomer component B and/or fillers. In addition, the powder-like cement component A or the monomer component B can also have additional components, particularly polymerization initiators, polymerization accelerators, pharmaceutical substances, as for example antibiotics, radiopaque materials, and/or dyes.

Figure 1:
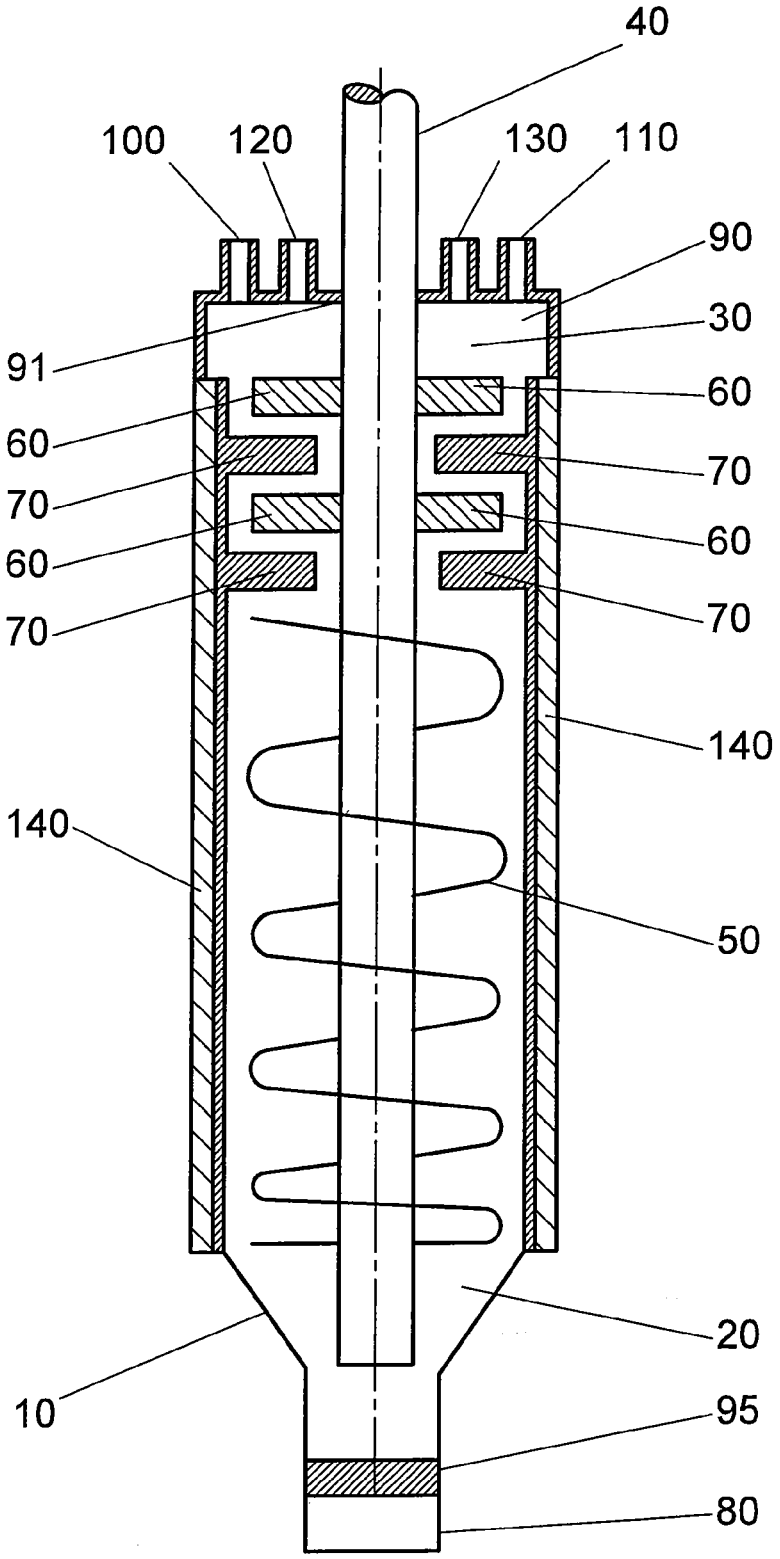
FIG. 1 is a schematic, longitudinal sectional view of an embodiment of the device according to the invention for the production of poly(methyl methacrylate) bone-cement pastes.

One embodiment of the device (10) according to the invention will be explained in detail with reference to FIG. 1.

Figure 2:
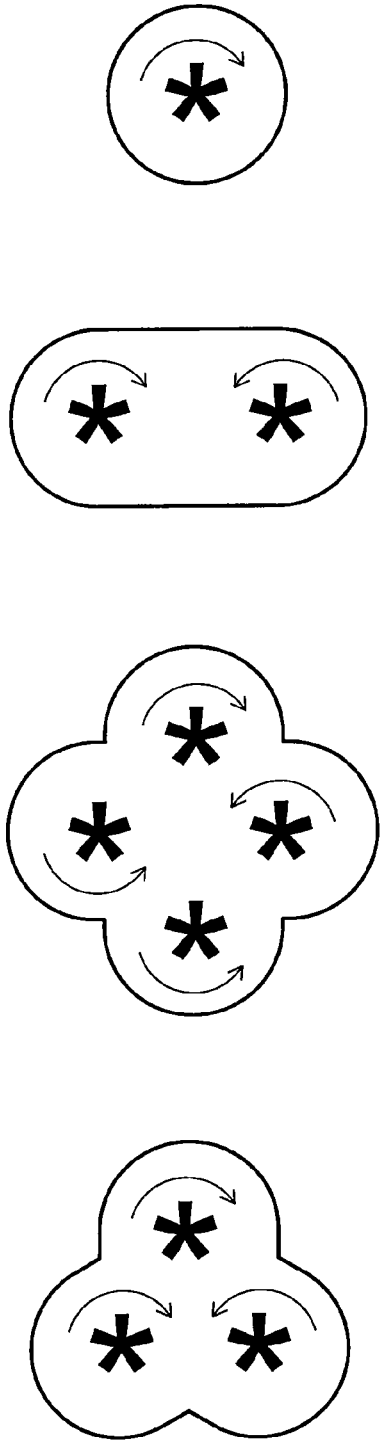
FIG. 2 is a schematic representation of four different cross sections of the tubular hollow body of possible embodiments of the device according to the invention for the production of poly(methyl methacrylate) bone-cement pastes. The arrows indicate other possible rotational directions of the shaft.

The device according to this embodiment of the invention has a tubular hollow body (10). Preferably, the tubular hollow body (10) has a circular or elliptical cross section. In addition, however, it is also possible according to the invention that the tubular hollow body (10) have a different cross section. For example, the cross section can also be formed by two or more than two, for example three, circular elements (lobes) adjacent to each other (see FIG. 2). The inner side of the tubular hollow body (10) preferably has a wear-resistant material or is lined with such a wear-resistant material, as for example a ceramic. In this way, it can be prevented that the inner side of the tubular hollow body (10) is damaged and that components possibly separated from the inner side of the tubular hollow body (10) reach into the bone-cement paste and negatively affect the quality of the bone cement.

The tubular hollow body (10) is preferably arranged vertically and has a first opening (30) and a second opening (20). Preferably, the first opening (30) bounds the tubular hollow body (10) at the top and the second opening (20) bounds the tubular hollow body (10) at the bottom. The first opening (30) is the input-side opening and the second opening (20) is the output-side opening.

The device according to the invention further has at least one rotatably-mounted shaft (40), arranged in the axial direction in the tubular hollow body (10). The shaft (40) itself can rotate axially according to the invention. Preferably, the shaft (40) is connected to a drive (not shown), which is capable of setting the shaft (40) into axial rotational movements. According to one embodiment of the invention, the cross section of the tubular hollow body is formed by two or more than two, for example three, circular elements or lobes adjacent to each other (see FIG. 2). In this case, it can be preferred that the number of shafts (40) contained in the tubular hollow body (10) corresponds to the number of circular elements adjacent to each other. Preferably, in this case, a shaft (40) is contained in each section of the tubular hollow body (10) formed by a circular element.

Thread turns (50) are arranged on the outer side of the at least one shaft (40). Preferably, thread turns (50) are understood to be any elements, which are inclined relative to an imaginary plane running perpendicular to the axis of the shaft (40) and are arranged like a spiral around the shaft. The spiral formed by the elements can be continuous (in the sense of a classical thread) or interrupted. The inclination angle of the elements relative to the imaginary plane equals preferably 1-30 and more preferably 5-20 degrees.

According to this embodiment of the invention, the shaft (40) has at least one section, in which the pitch of the thread turns (50) decreases in the direction of the second opening (20). According to the invention, pitch is understood to be the distance of adjacent thread turns on a straight line parallel to the axis of the shaft (40) and along the shaft (40). Consequently, it can be preferred that the pitch of the thread turns (50) decreases continuously from the first opening (30) in the direction of the second opening (20). On the other hand, according to this embodiment of the invention it is likewise provided that, in addition to the section in which the pitch of the thread turns (50) decreases in the direction of the second opening (20), at least one additional section is present, in which the pitch of the thread turns (50) does not decrease in the direction of the second opening (20). According to one embodiment, the shaft (40) has several sections arranged in the axial direction with thread turns (50), wherein in at least one section the pitch of the thread turns (50) decreases in the direction of the second opening (20). Preferably, this section is the next adjacent section with thread turns (50) in the direction of the second opening (20).

The device according to this embodiment of the invention further has at least one stirring blade (60) arranged on the shaft (40). It can be preferred that several stirring blades (60) are located axially along the shaft (40). The stirring blades (60) are preferably arranged such that, in the operation of the device, a mass flow is generated from the input-side opening (30) in the direction of the output-side opening (20). This can be achieved, for example, in that the stirring blades (60) are inclined relative to an imaginary plane running perpendicular to the axis of the shaft (40). The shape of the stirring blades (60) and the number of stirring blades (60) arranged on an imaginary plane perpendicular to the axis of the shaft (40) are not limited. According to an embodiment of the invention, it can be preferred if the stirring blades (60) have a rod-shaped construction. It can be further preferred if two, three, four, five, or more stirring blades (60) are located in a plane parallel to the axis of the shaft (40). Preferably, the stirring blades (60) attached in a plane parallel to the axis of the shaft (40) are arranged so that their distance is at a maximum. Accordingly, the stirring blades (60) stand in a plane perpendicular to the axis of the shaft (40), preferably at an angle to each other of approximately 180°, 120°, 90°, 72°, or less.

In addition, the device according to this embodiment of the invention has rigid mixing elements (70) arranged on the inner side of the tubular body (10). The rigid mixing elements (70) are preferably connected integrally with the inner side of the tubular body (10). According to one preferred embodiment, the rigid mixing elements (70) have a rod-like construction. Several rigid mixing elements (70), particularly two, three, four, five, or more rigid mixing elements (70) can be located on a plane running perpendicular to the axis of the shaft (40). Preferably, the rigid mixing elements (70) arranged in a plane perpendicular to the axis of the shaft (40) have a maximum spacing. Accordingly, the rigid mixing elements (70) stand in a plane perpendicular to the axis of the shaft (40) preferably at an angle to each other of approximately 180°, 120°, 90°, 72° or less.

Preferably, the stirring blades (60) and the rigid mixing elements (70) are arranged alternating to each other. Consequently, at least one stirring blade (60) is attached preferably along the shaft (40), with this blade being adjacent to at least two rigid mixing elements (70) not located within the same plane perpendicular to the axis of the shaft (40). It is further preferred that at least one rigid mixing element (70) is attached to the inner side of the tubular hollow body (10), with this rigid mixing element being adjacent to at least two stirring blades (60) not located within the same plane perpendicular to the axis of the shaft (40).

According to embodiments of the invention, the stirring blades (60), the mixing elements (70), and the thread turns (50) are arranged so that a rotational movement of the shaft (40) leads to a mass flow of a material located in the device from the first opening (30) in the direction of the second opening (20). Preferably, the material includes the powder-like component A, the liquid monomer component B, or a cement mixture C made from the powder-like component A and the liquid monomer component B. The cement mixture C is preferably paste-like. Consequently, the stirring blades (60) are oriented such that, with rotational movements of the shaft (40), the cement mixture C moves in the direction of the opening (20). Furthermore, the thread turns (50) are arranged such that, with rotational movements of the shaft (40), the cement mixture C moves in the direction of the opening (20).

The stirring blades (60), the mixing elements (70), and the thread turns (50) are further arranged such that, with rotational movement of the shaft (40), the stirring blades (60) shear the cement mixture C at the rigid mixing elements (70), and the thread turns (50) transport and compact the sheared cement mixture C in the direction of the opening (20) and can press it out from the opening (20). With the compaction of the cement mixture C, included air and gas residues are removed.

According to one especially preferred embodiment, the section of the shaft (40) having the thread turns (50) is arranged after the section of the shaft (40) having the stirring blades (60). According to this embodiment, the section of the shaft (40) having the thread turns (50) is located farther in the direction of the output-side opening (20) than the section of the shaft (40) having the stirring blades (60).

According to another preferred embodiment, the outer diameter of the thread turns (50) is equal at a maximum to the inner diameter of the tubular hollow body (10).

It can be further advantageous if the tubular hollow body (10) is constructed at the second opening (20) as a nozzle tube (80) and that optionally a slide (95) is also arranged in the nozzle tube (80) perpendicular to the axis of the nozzle tube (80).

According to another preferred embodiment, the first opening (30) is closed with a cap (90) containing one or more bushings (91) for one or more shafts (40), at least one supply opening (100) for the powder component, and at least one supply opening (110) for the monomer liquid, and optionally an exhaust-air opening (120) and optionally a gassing opening (130).

Furthermore, it is advantageous if a temperature-equalizing jacket (140) is attached around the tubular hollow body. This temperature-equalizing jacket (140) can carry a flow of thermostatic water or other suitable fluids. Furthermore, it is possible to provide an electric heater and/or Peltier cooler in the temperature-equalizing jacket (140). During the compaction of the cement mixture C, the temperature-equalizing jacket (140) can prevent an undesired heating of the cement mixture C, which could promote spontaneous polymerization. Furthermore, a constant temperature of the cement paste C is desirable, so that the viscosity and the volume of the cement paste remain constant during the subsequent filling process.

With the method according to the invention, the powder-like cement component A is introduced through the first supply opening (100), and the liquid monomer component B is introduced through the second supply opening (110) continuously into the hollow body (10). Upon mixing of the powder-like cement component A and the liquid monomer component B, a cement mixture C is formed by swelling. By causing axial rotational movements of the shaft (40), a mass flow of the cement mixture C is generated from the first opening (30) in the direction of the second opening (20), and the cement mixture is pressed out from the second opening (20).

Through the axial rotational movements of the shaft (40), the cement mixture C is moved by the stirring blades (60) in the direction of the rigid mixing elements (70), whereby this leads to a shearing of the cement mixture C. Through the shearing of the cement mixture C at the rigid mixing elements (70), this leads to a rapid swelling of the cement mixture C. Therefore, the dwell time of the cement mixture C in the mixing device can be reduced drastically. With subsequent transport of the cement mixture C in the direction of the output-side opening (20), due to the decreasing pitch of the thread turns (50) arranged on the shaft (40), the cement mixture C is compacted. Upon compaction, gas bubbles included in the cement mixture C are removed. Therefore, the production of largely degassed cement pastes is made possible. Finally, the cement mixture C is pressed out from the opening (20).

Through the rapid swelling of the cement mixture C, on one hand, and the removal of the gas bubbles from the cement mixture C, on the other hand, it is possible according to the invention to produce largely bubble-free poly(methyl methacrylate) bone-cement pastes from a powder-like cement component A and a liquid monomer component B within a short time period and to discharge them from the device. Therefore, poly(methyl methacrylate) bone-cement pastes can be produced continuously according to the invention, whereby the volume of the mixing vessel can be kept small.

The method according to the invention thus allows the continuous production of poly(methyl methacrylate) bone-cement pastes.

According to a preferred embodiment, the mixing of the powder-like cement component A with the liquid monomer component B occurs at a temperature in the range of −30° C. to +60° C. Preferably, the powder-like cement component A is mixed with the liquid monomer component B at this temperature within 5 to 20 minutes, so that the paste-like cement mass C forms continuously.

Preferably, the mixing is performed such that, during the mixing process, dissolving processes and swelling processes take place in the cement component C.

It is likewise preferred that during the mixing process, no radical polymerization is started in the cement mixture C. Consequently, the method according to the invention does not involve a variant of the reactive injection-molding process.

It is further preferred that during the mixing process, no partial melting or fusion of components of the cement mixture C takes place. Consequently, the mixing process also does not involve an extrusion process that is typical in the plastics industry.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A device for production of poly(methyl methacrylate) bone-cement pastes from a powder-like cement component A and a liquid monomer component B, the device comprising:

a tubular hollow body (10) having a first opening (30) on an input side and a second opening (20) on an output side, at least one rotatably-mounted shaft (40) arranged in an axial direction in the tubular hollow body (10), thread turns (50) arranged axially along an outer side of the at least one shaft (40), wherein the shaft (40) has at least one section having thread turns (50) whose pitch decreases in a direction of the second opening (20), and wherein an outer diameter of the thread turns (50) is equal at a maximum to an inner diameter of the tubular hollow body (10), at least one stirring blade (60) arranged on the at least one shaft (40), and rigid mixing elements (70) arranged on an inner side of the tubular hollow body (10).

2. The device according to claim 1, wherein the tubular hollow body (10) is arranged vertically, the first opening (30) bounds the tubular hollow body (10) at a top, and the second opening (20) bounds the tubular hollow body (10) at a bottom.

3. The device according to claim 1, wherein the tubular hollow body is constructed at the second opening (20) as a nozzle tube (80).

4. The device according to claim 1, wherein the opening (30) is closed with a cap (90) having at least one bushing (91) for the at least one shaft (40), a first supply opening (100) for the powder-like cement component A, and a second supply opening (110) for the liquid monomer component B.

5. The device according to claim 1, wherein the at least one stirring blade (60) is oriented such that, through rotational movements of the at least one shaft (40), a cement mixture C to be mixed is moved in the direction of the second opening (20).

6. The device according to claim 1, wherein the thread turns (50) are arranged such that a cement mixture C to be mixed is moved by rotational movements of the at least one shaft (40) in the direction of the second opening (20).

7. A method for production of poly(methyl methacrylate) bone-cement pastes from a powder-like cement component A and a liquid monomer component B using a device comprising:

a tubular hollow body (10) having a first opening (30) on an input side and a second opening (20) on an output side, a first supply opening (100) for the powder-like cement component A, and a second supply opening (110) for the liquid monomer component B, at least one rotatably-mounted shaft (40) arranged in an axial direction in the tubular hollow body (10), wherein the first opening (30) is closed with a cap (90) having at least one bushing (91) for the at least one shaft (40), thread turns (50) arranged axially along an outer side of the at least one shaft (40), wherein the shaft (40) has at least one section having thread turns (50) whose pitch decreases in a direction of the second opening (20), at least one stirring blade (60) arranged on the at least one shaft (40), and rigid mixing elements (70) arranged on an inner side of the tubular hollow body (10), the method comprising:

continuously introducing the powder-like cement component A through the first supply opening (100) and the liquid monomer component B through the second supply opening (110) into the tubular hollow body (10), mixing the powder-like cement component A and the liquid monomer component B such that a paste-like cement mixture C is formed by swelling, causing axial rotational movements of the shaft (40), such that a mass flow of the paste-like cement mixture C is generated from the first opening (30) in the direction of the second opening (20), and pressing the cement mixture C out from the second opening (20).

8. The method according to claim 7, wherein the powder-like cement component A is mixed with the liquid monomer component B at a temperature in a range of −30° C. to +60° C. within 5 to 20 minutes, such that the paste-like cement mixture C is produced continuously.

9. The method according to claim 7, wherein the mixing is carried out such that, during the mixing, dissolving processes and swelling processes take place in the paste-like cement mixture C.

10. The method according to claim 7, wherein, during the mixing, no radical polymerization is started in the paste-like cement mixture C.

11. The method according to claim 7, wherein no partial melting or fusion of components of the paste-like cement mixture C takes place.

12. A device for production of poly(methyl methacrylate) bone-cement pastes from a powder-like cement component A and a liquid monomer component B, the device comprising:

a tubular hollow body (10) having a first opening (30) on an input side and a second opening (20) on an output side, wherein the tubular hollow body is constructed at the second opening (20) as a nozzle tube (80), at least one rotatably-mounted shaft (40) arranged in an axial direction in the tubular hollow body (10), thread turns (50) arranged axially along an outer side of the at least one shaft (40), wherein the shaft (40) has at least one section having thread turns (50) whose pitch decreases in a direction of the second opening (20), at least one stirring blade (60) arranged on the at least one shaft (40), rigid mixing elements (70) arranged on an inner side of the tubular hollow body (10), and a slide (95) arranged in the nozzle tube (80) perpendicular to a longitudinal axis of the nozzle tube (80).

13. A device for production of poly(methyl methacrylate) bone-cement pastes from a powder-like cement component A and a liquid monomer component B, the device comprising:

a tubular hollow body (10) having a first opening (30) on an input side and a second opening (20) on an output side, wherein the opening (30) is closed with a cap (90) having at least one bushing (91) for the at least one shaft (40), a first supply opening (100) for the powder-like cement component A, and a second supply opening (110) for the liquid monomer component B, and wherein the cap (90) has an exhaust-air opening (120), at least one rotatably-mounted shaft (40) arranged in an axial direction in the tubular hollow body (10), thread turns (50) arranged axially along an outer side of the at least one shaft (40), wherein the shaft (40) has at least one section having thread turns (50) whose pitch decreases in a direction of the second opening (20), at least one stirring blade (60) arranged on the at least one shaft (40), and rigid mixing elements (70) arranged on an inner side of the tubular hollow body (10).

14. A device for production of poly(methyl methacrylate) bone-cement pastes from a powder-like cement component A and a liquid monomer component B, the device comprising:

a tubular hollow body (10) having a first opening (30) on an input side and a second opening (20) on an output side, wherein the opening (30) is closed with a cap (90) having at least one bushing (91) for the at least one shaft (40), a first supply opening (100) for the powder-like cement component A, and a second supply opening (110) for the liquid monomer component B, and wherein the cap (90) has a gassing opening (130), at least one rotatably-mounted shaft (40) arranged in an axial direction in the tubular hollow body (10), thread turns (50) arranged axially along an outer side of the at least one shaft (40), wherein the shaft (40) has at least one section having thread turns (50) whose pitch decreases in a direction of the second opening (20), at least one stirring blade (60) arranged on the at least one shaft (40), and rigid mixing elements (70) arranged on an inner side of the tubular hollow body (10).

15. A device for production of poly(methyl methacrylate) bone-cement pastes from a powder-like cement component A and a liquid monomer component B, the device comprising:

a tubular hollow body (10) having a first opening (30) on an input side and a second opening (20) on an output side, at least one rotatably-mounted shaft (40) arranged in an axial direction in the tubular hollow body (10), thread turns (50) arranged axially along an outer side of the at least one shaft (40), wherein the shaft (40) has at least one section having thread turns (50) whose pitch decreases in a direction of the second opening (20), at least one stirring blade (60) arranged on the at least one shaft (40), rigid mixing elements (70) arranged on an inner side of the tubular hollow body (10), and a temperature-equalizing jacket (140) attached around the tubular hollow body.

* * * * *